US008590701B2

(12) United States Patent
Bertuzzi et al.

(10) Patent No.: US 8,590,701 B2
(45) Date of Patent: Nov. 26, 2013

(54) RIGID HINGED-LID PACKAGE AND RELATIVE PACKING METHOD AND MACHINE

(75) Inventors: Ivanoe Bertuzzi, Casalecchio di Reno (IT); Alessandro Minarelli, Bazzano (IT); Andrea Biondi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 293 days.

(21) Appl. No.: 13/033,316

(22) Filed: Feb. 23, 2011

(65) Prior Publication Data

US 2011/0233080 A1 Sep. 29, 2011

(30) Foreign Application Priority Data

Feb. 23, 2010 (IT) ..... BO2010A0098

(51) Int. Cl.
*B65D 85/10* (2006.01)
*B65D 85/12* (2006.01)
*A24F 15/00* (2006.01)

(52) U.S. Cl.
USPC ..... 206/268; 206/264; 206/273; 229/160.1

(58) Field of Classification Search
USPC ..... 206/242–276; 229/125.125, 160.1
See application file for complete search history.

(56) References Cited

U.S. PATENT DOCUMENTS

| | | | | |
|---|---|---|---|---|
| 4,300,676 | A | 11/1981 | Focke et al. | |
| 6,164,444 | A * | 12/2000 | Bray et al. | 206/268 |
| 6,478,149 | B1 * | 11/2002 | Parker | 206/273 |
| 6,726,006 | B1 * | 4/2004 | Funderburk et al. | 206/268 |
| 8,123,030 | B2 * | 2/2012 | Hein | 206/273 |
| 2003/0164314 | A1 * | 9/2003 | Bray | 206/264 |
| 2007/0193896 | A1 * | 8/2007 | Tanbo et al. | 206/259 |
| 2010/0230303 | A1 | 9/2010 | Buse et al. | |
| 2011/0114518 | A1 | 5/2011 | Hein | |

FOREIGN PATENT DOCUMENTS

| | | | |
|---|---|---|---|
| DE | 10 2008 033 937 | A1 | 1/2009 |
| DE | 102007030267 | | 1/2009 |
| DE | 102008035467 | A1 | 2/2010 |
| EP | 1803661 | A1 | 7/2007 |
| EP | 1997735 | A2 | 12/2008 |
| GB | 2 451 180 | A | 1/2009 |
| WO | WO2010012370 | * | 2/2010 |

OTHER PUBLICATIONS

European Search Report in Application No. EP 11 15 5720 dated Apr. 13, 2011.

* cited by examiner

*Primary Examiner* — Mickey Yu
*Assistant Examiner* — Chun Cheung
(74) *Attorney, Agent, or Firm* — Marshall, Gerstein & Borun LLP

(57) ABSTRACT

A rigid package having a group of articles; an inner package enclosing the group of articles, and having an extraction opening defined by a U-shaped first incision; a reclosable scaling panel for closing the extraction opening of the inner package; a rigid outer container housing the inner package and having an open end; and a rigid collar, which projects partly from the open end of the outer container, is folded about the inner package to at least partly cover a top portion of the inner package, and is fixed to the inner package.

The reclosable sealing panel is positioned over the collar, and has an inner surface gummed with non-dry, re-stick adhesive, and which adheres to the collar when the reclosable scaling panel is in a closed position.

14 Claims, 12 Drawing Sheets

RIGID HINGED-LID PACKAGE AND RELATIVE PACKING METHOD AND MACHINE

CROSS-REFERENCE TO RELATED APPLICATIONS

This application claims the benefit of Italian Patent Application No. BO2010A 000098, filed Feb. 23, 2010.

TECHNICAL FIELD

The present invention relates to a rigid hinged-lid package and relative packing method and machine.

In the following description, reference is made, for the sake of simplicity and purely by way of a non-limiting example, to a rigid, hinged-lid packet of cigarettes.

BACKGROUND ART

A rigid, hinged-lid packet of cigarettes normally comprises an inner package enclosing a group of cigarettes; and a rigid outer package housing the inner package.

To preserve the organoleptic characteristics of the cigarette tobacco, it is common practice to employ a sealed inner package, which is formed by folding and heat sealing a sheet of airtight packing material featuring a reclosable cigarette extraction opening.

One problem of rigid packets of cigarettes in which the inner package is formed as described above is the tendency of the inner package to collapse after some of the cigarettes are withdrawn, thus making it difficult to extract the remaining cigarettes and, in particular, to open and close the sealing panel.

DESCRIPTION OF THE INVENTION

It is an object of the present invention to provide a rigid, hinged-lid package and relative packing method and machine, designed to eliminate the above drawbacks and which at the same time are cheap and easy to implement.

According to the present invention, there are provided a rigid, hinged-lid package and relative packing method and machine, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 3:
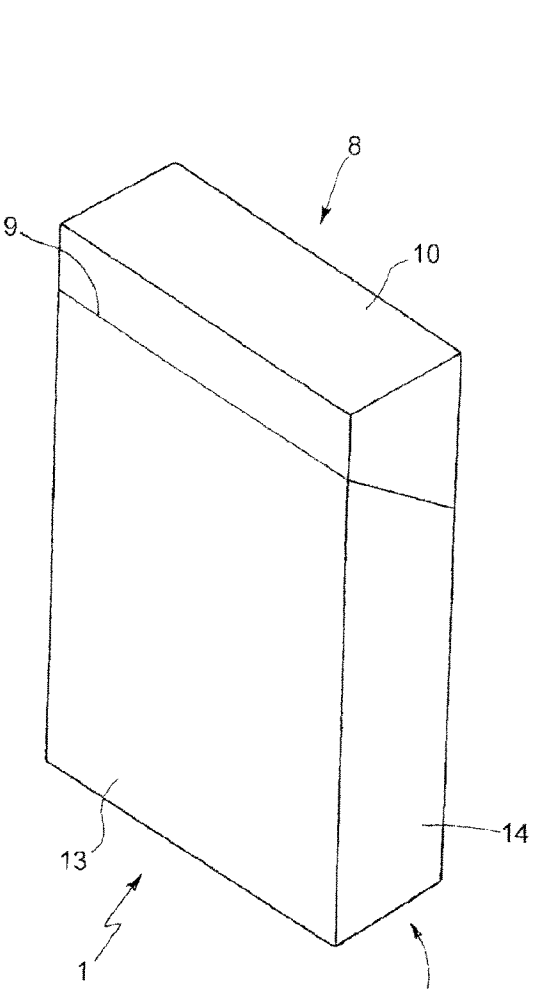
FIG. 3 shows a rear view in perspective of the FIG. 1 packet of cigarettes in the closed configuration.
Figure 2:
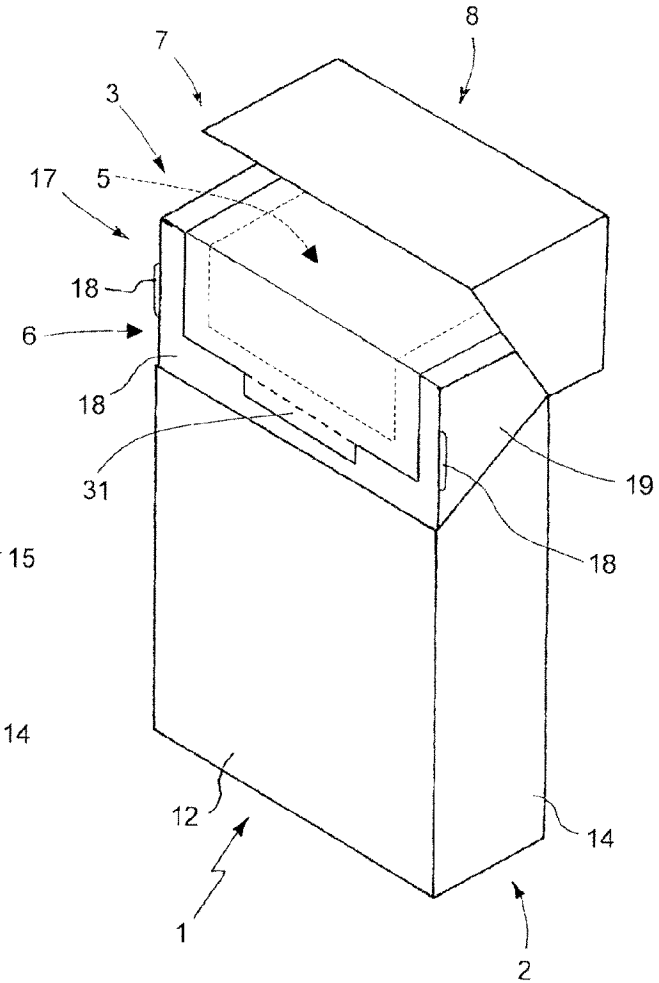
FIG. 2 shows a front view in perspective of the FIG. 1 packet of cigarettes in an open configuration.
Figure 1:
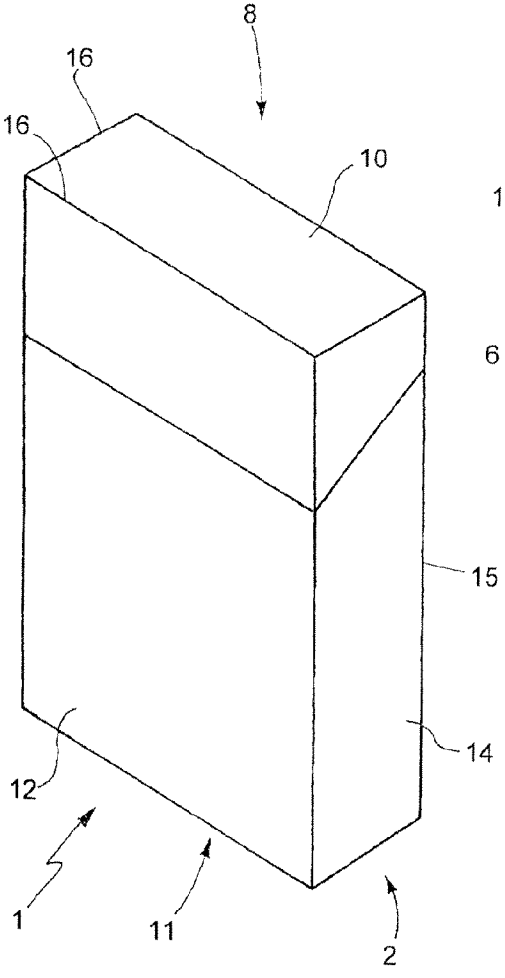
FIG. 1 shows a front view in perspective of a packet of cigarettes in accordance with the present invention and in a closed configuration.
Figure 5:
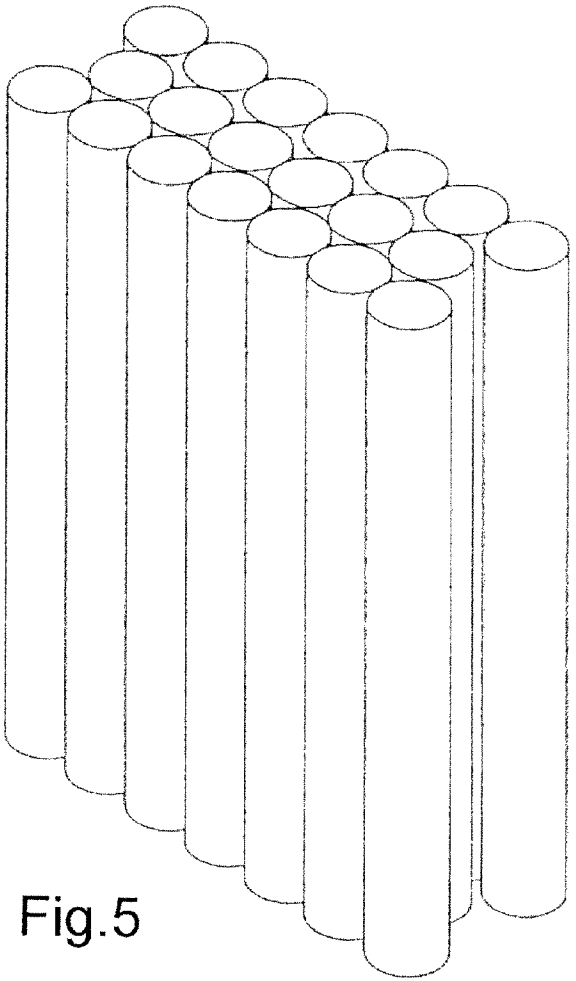
FIG. 5 shows a view in perspective of a group of cigarettes enclosed in the FIG. 4 inner package.
Figure 4:
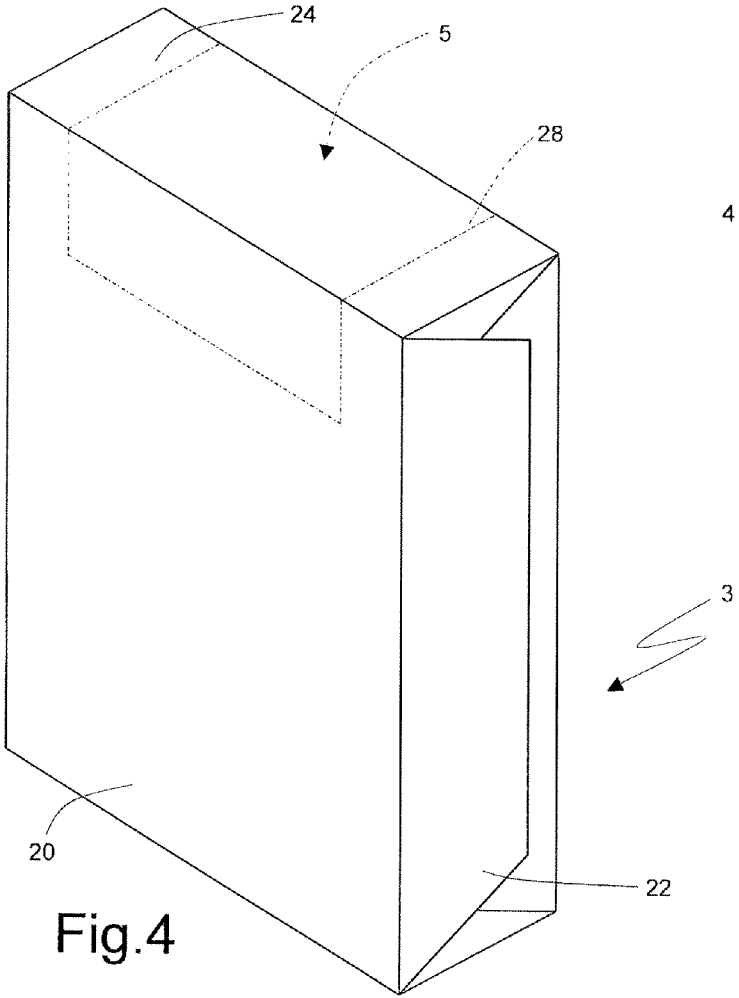
FIG. 4 shows a front view in perspective of an inner package of the FIG. 1 packet of cigarettes.

Number 1 in FIGS. 1, 2 and 3 indicates as a whole a rigid packet of cigarettes, which comprises a cup-shaped outer container 2 made of cardboard; and a sealed inner package 3 (FIG. 4) housed inside container 2. The sealed inner package 3 encloses a parallelepiped-shaped group 4 of cigarettes (FIG. 5), and has, at the top and front, a central cigarette extraction opening 5 closed by a reclosable (i.e. open-close) sealing panel 6, and which extends over a front-wall portion and a top-wall portion of sealed inner package 3. Sealing panel 6 is movable between a closed position closing extraction opening 5 (as shown in FIGS. 1, 3, 6 and 7), and an open position opening extraction opening 5 (as shown in FIG. 8). Sealing panel 6 is normally in the closed position closing extraction opening 5, and is raised temporarily into the open position to permit withdrawal of the cigarettes through extraction opening 5.

Outer container 2 has an open top end 7; and a cup-shaped lid 8 hinged to container 2 along a hinge 9 to rotate, with respect to container 2, between an open position (FIG. 2) and a closed position (FIGS. 1 and 3) opening and closing open top end 7 respectively.

When lid 8 is in the closed position, outer container 2 is in the form of a rectangular parallelepiped comprising a top wall 10 and bottom wall 11 opposite and parallel to each other; two opposite parallel major lateral walls 12, 13; and two opposite parallel minor lateral walls 14. More specifically, one major lateral wall 12 defines a front wall 12 of outer container 2, and the other major lateral wall 13 defines a rear wall 13 of outer container 2. Four longitudinal edges 15 are defined between lateral walls 14 and front and rear walls 12, 13; and eight transverse edges 16 are defined between top and bottom walls 10, 11 and front, rear, and lateral walls 12, 13, 14.

In the FIG. 1-3 embodiment, edges 15 and 16 are all square, but in alternative embodiments not shown, some of edges 15 and 16 may be bevelled or rounded.

Packet 1 also comprises a rigid (i.e. rigid-cardboard) collar 17, which is folded about inner package 3 to at least partly cover a top portion of inner package 3, and is fixed (normally glued) to inner package 3. In one embodiment, inner package 3 and/or collar 17 (which are glued integrally and non-detachably to each other) are/is also glued to outer container 2. Collar 17 (together with inner package 3 covered partly by it) projects partly outwards of open top end 7, and engages a corresponding inner surface of lid 8 when lid 8 is closed. In a preferred embodiment, collar 17 has two lateral projections 18, which interferentially engage the lateral walls of lid 8 to hold lid 8 in the closed position.

Figure 6:
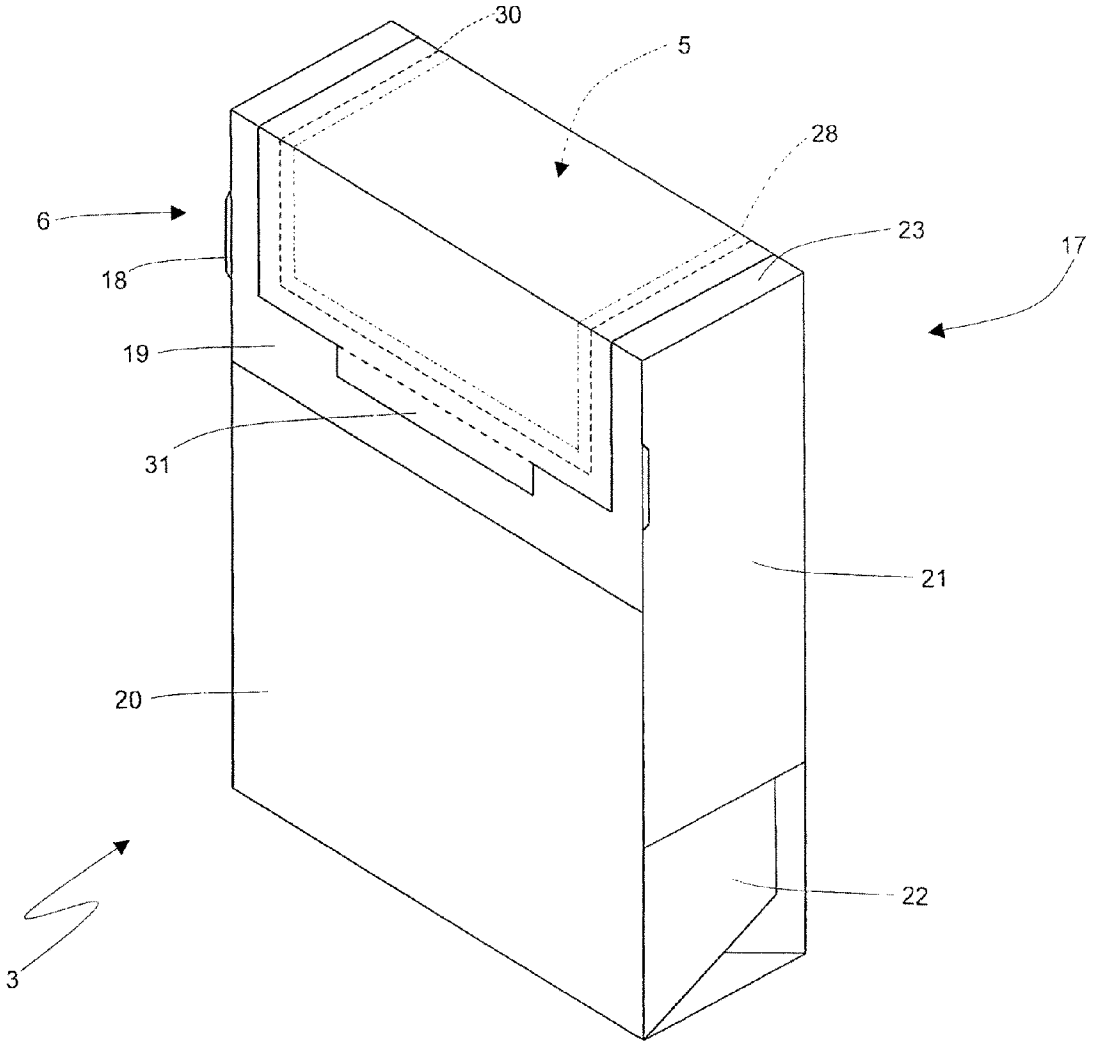
FIGS. 6 and 7 show, respectively, a front and rear view in perspective of the FIG. 4 inner package in a closed configuration and enclosed in a collar partly covering a top portion of the inner package.
Figure 7:
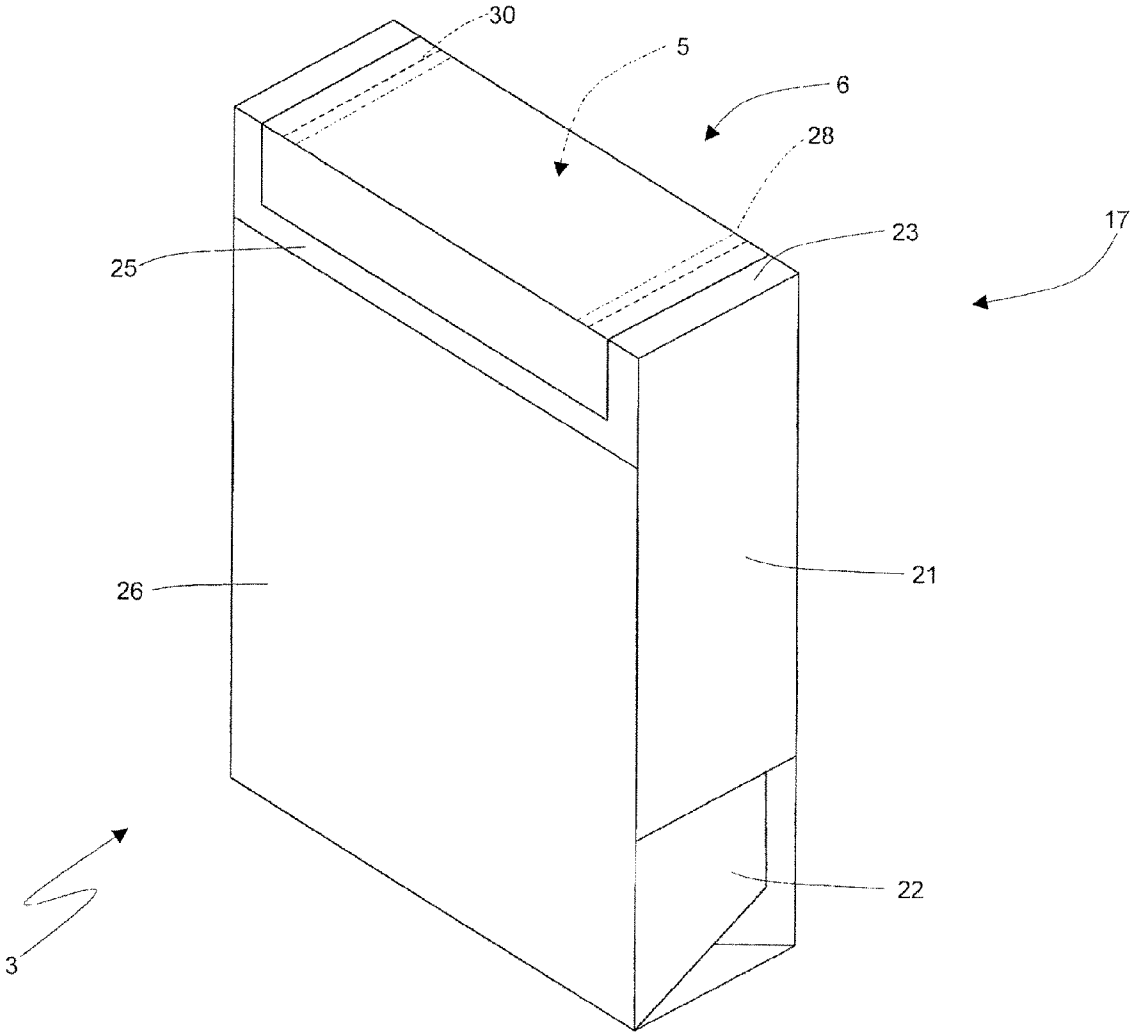
Figure 8:
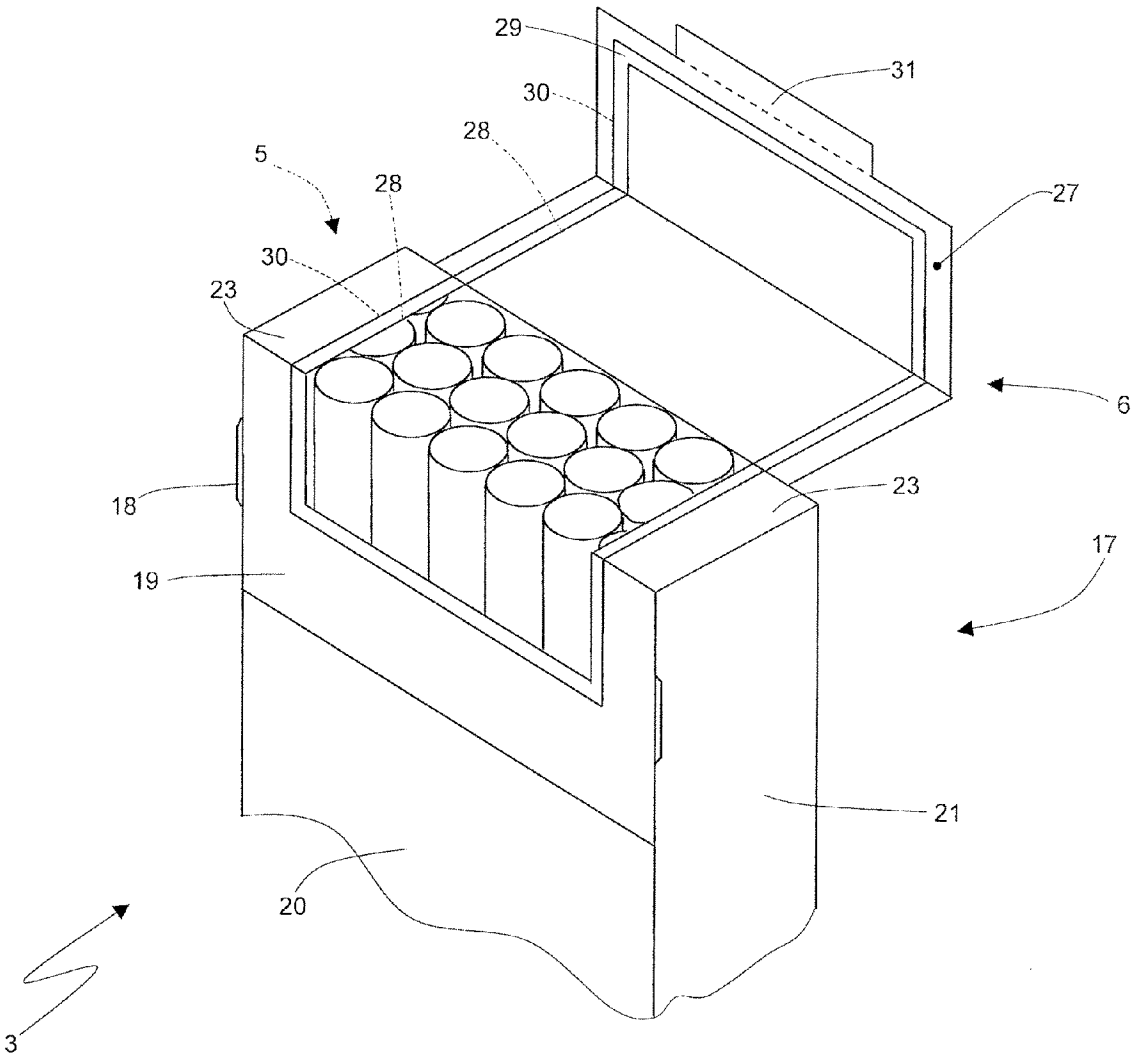
FIG. 8 shows a front view in perspective of the FIG. 4 inner package in an open configuration and enclosed in the collar.

As shown more clearly in FIGS. 6, 7 and 8, collar 17 comprises a front wall 19, which on the inside contacts a front wall 20 of inner package 3, and on the outside contacts front wall 12 of outer container 2; two lateral walls 21 located on opposite sides of front wall 19, and which on the inside contact the lateral walls 22 of inner package 3, and on the outside contact minor lateral walls 14 of outer container 2; a top wall 23, which on the inside contacts a top wall 24 of inner package 3 (FIG. 4), and on the outside contacts top wall 10 of outer container 2 when lid 8 is closed; and a rear wall 25, which on the inside contacts a rear wall 26 of inner package 3, and on the outside contacts rear wall 13 of outer container 2 when lid 8 is closed.

Reclosable sealing panel 6 for closing extraction opening 5 of inner package 3 is located over collar 17, and has an inner surface 27 (FIG. 8), which is gummed with non-dry, re-stick adhesive, and adheres to collar 17 (or, rather, to the parts of walls 19 and 23 of collar 17 surrounding extraction opening 5) when reclosable sealing panel 6 is closed. In other words, when closed, reclosable sealing panel 6 adheres to the parts of walls 19 and 23 of collar 17 surrounding extraction opening 5, to close (seal) extraction opening 5, and can be lifted temporarily into the open position to open, and permit withdrawal of the cigarettes through, extraction opening 5. More specifically, reclosable sealing panel 6 is fixed permanently at the rear wall 26 of inner package 3, and rotates, between the open and closed positions to open and close extraction opening 5, about a hinge along a transverse edge between top wall 24 and rear wall 26 of inner package 3 (i.e. between top wall 23 and rear wall 25 of collar 17, i.e. between top wall 10 and rear wall 13 of outer container 2).

As shown in FIGS. 4 and 6-8, cigarette extraction opening 5 of inner package 3 is defined by a U-shaped incision 28 formed in a top portion of front wall 20 of inner package 3, and extending along the whole of top wall 24 of inner package 3 (without touching rear wall 26 of inner package 3, i.e. only extending as far as a transverse edge between top wall 24 and rear wall 26 of inner package 3).

In a preferred embodiment, reclosable sealing panel 6 incorporates a detachable portion 29 (FIG. 8) of collar 17, which is separated from the rest of collar 17 by a U-shaped incision 30 enclosing incision 28 of extraction opening 5. Detachable portion 29 of collar 17 is glued on one side to sealing panel 6 (i.e. to inner surface 27 of sealing panel 6) by the non-dry, re-stick glue on sealing panel 6, and is glued on the other side to the part of inner package 3 bounded by incision 28 by further adhesive applied for the purpose (and which may be either non-dry, re-stick or permanent adhesive).

In a preferred embodiment, reclosable sealing panel 6 has a grip tab 31 with no re-stick adhesive on inner surface 27, and which is located close to, normally below, extraction opening 5 for easy grip and lift of sealing panel 6. In other words, sealing panel 6 can be raised by the user simply gripping grip tab 31, which, unlike the rest of sealing panel 6, is in no way fixed to collar 17 underneath.

Figure 9:
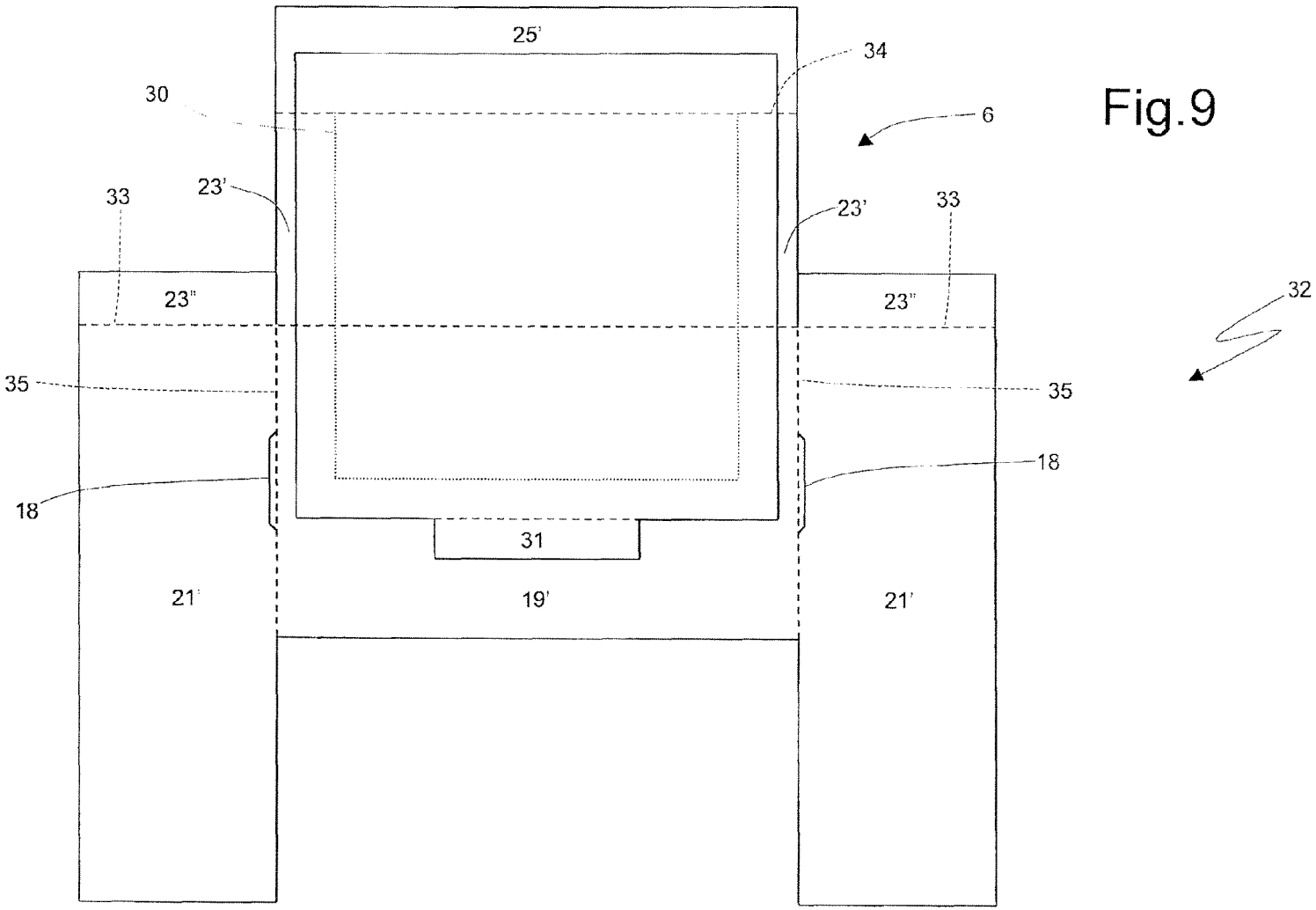
FIG. 9 shows a spread-out plan view of the FIGS. 6, 7 and 8 collar.
Figure 10:
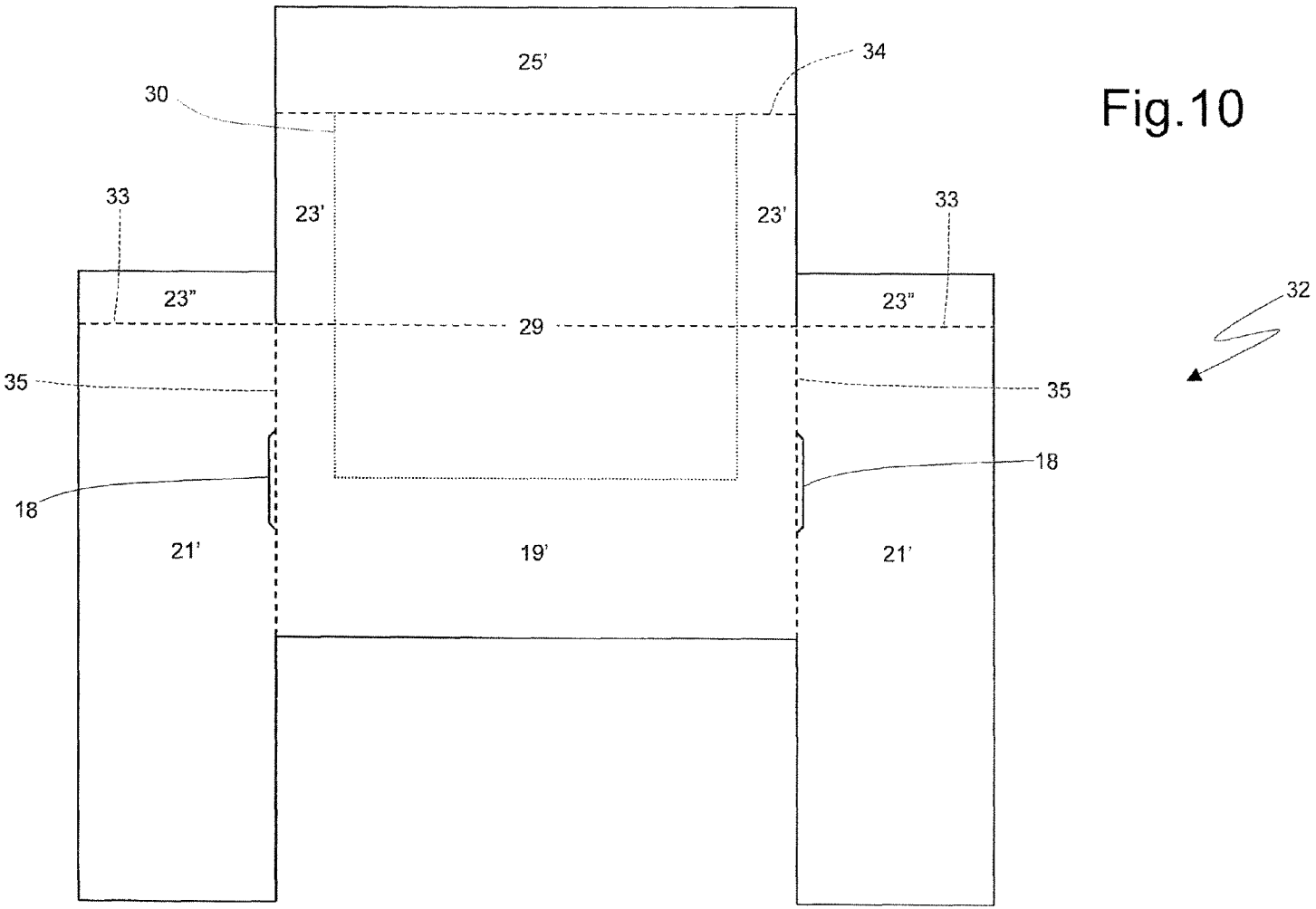
FIG. 10 shows a spread-out plan view of the FIG. 8 collar without a reclosable sealing panel.
Figure 11:
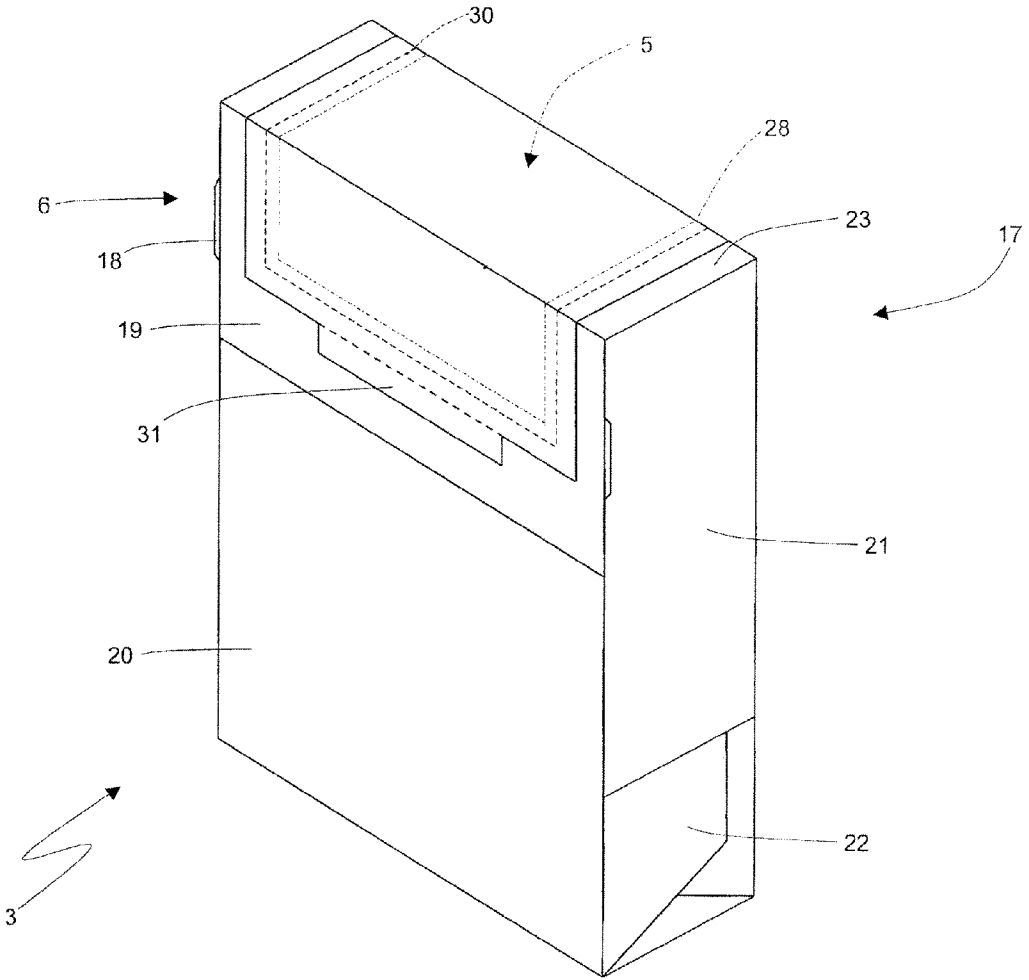
FIGS. 11 and 12 show, respectively, a front and rear view in perspective of the FIG. 4 inner package in the closed configuration and enclosed in a different embodiment of the collar partly covering a top portion of the inner package.
Figure 12:
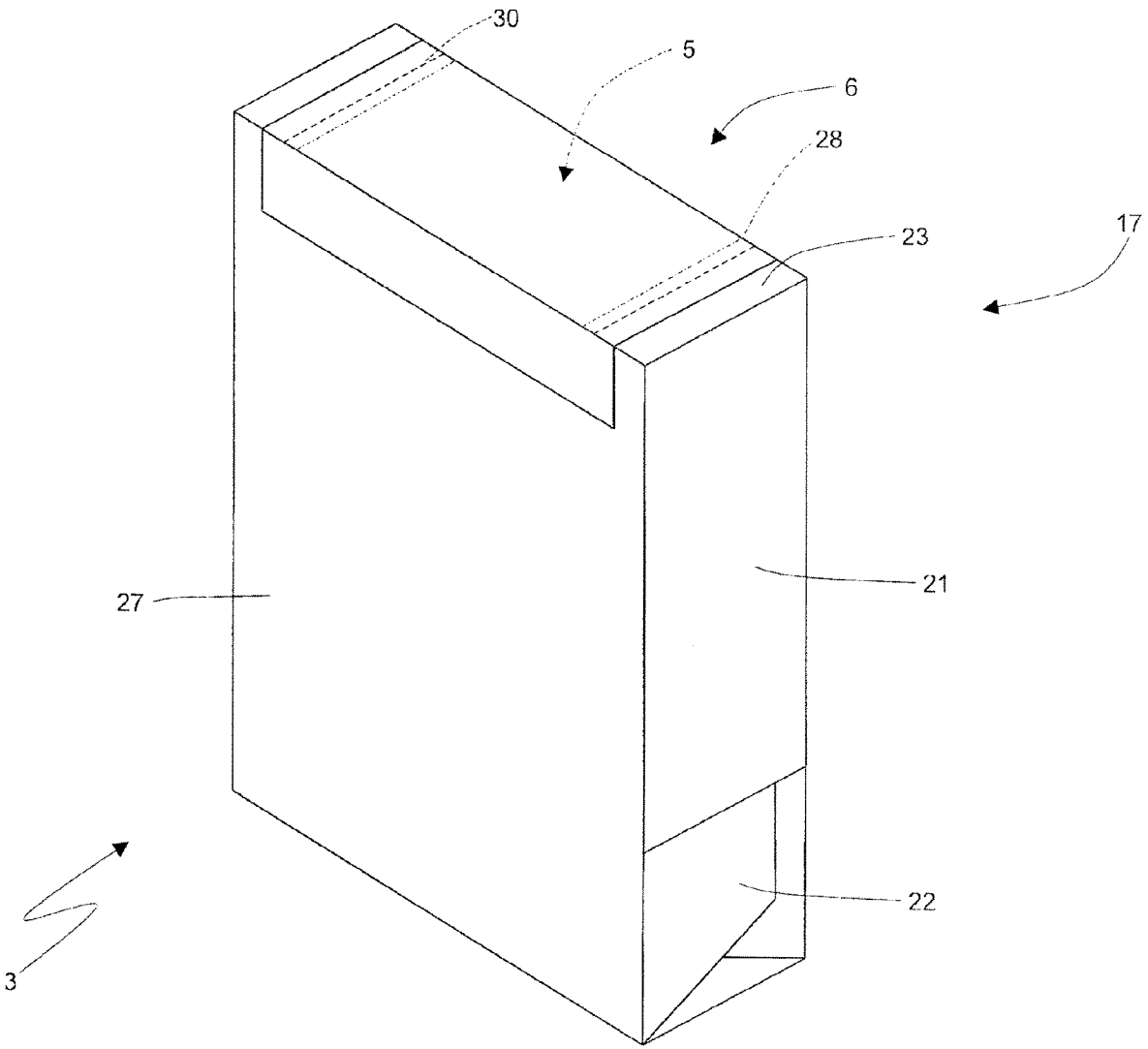

As shown in FIGS. 9 and 10, collar 17 is made from a single blank 32, which is folded about inner package 3 and comprises: a panel 19' forming front wall 19 of collar 17; a panel 23' forming top wall 23 of collar 17 and separated from panel 19' by a transverse fold line 33; a panel 25' forming rear wall 25 of collar 17 and separated from panel 23' by a transverse fold line 34; two panels 21' which form lateral walls 21 of collar 17, are located on opposite sides of panel 19', and are separated from panel 19' by two longitudinal fold lines 35; and two tabs 23", which are glued to the inside of panel 23' forming top wall 23 of collar 17, are located on opposite sides of panel 23', and are separated from panel 23' by transverse fold line 33. FIG. 10 clearly shows the detachable portion 29 of collar 17, which extends over panel 19' (i.e. front wall 19) and panel 23' (i.e. top wall 23).

It is important to note that incisions 28 and 30 may be either continuous through incisions (i.e. continuous cuts from the outset through inner package 3 and collar 17 respectively) or partial incisions (i.e. initially defining, in inner package 3 and collar 17, respective tear lines, which form respective continuous tears through inner package 3 and collar 17 when sealing panel 6 is unsealed). Incisions 28 and 30 are preferably partial to avoid excessively weakening inner package 3 and collar 17 during the folding process, and may be partial in the sense of either only being formed through part of the thickness of the packing material (i.e. non-through incisions), or being formed in discontinuous 'portions' (i.e. respective 'perforated' lines).

In the FIG. 6-10 embodiment, rear wall 25 of collar 17 partly covers rear wall 26 of inner package 3, and reclosable sealing panel 6 is fixed permanently to rear wall 25 of collar 17. The non-dry, re-stick adhesive on inner surface 27 of sealing panel 6 glues sealing panel 6 permanently (i.e. non-detachably) to rear wall 25 of collar 17 and to detachable portion 29 of collar 17 (which in turn is glued permanently to the part of inner package 3 bounded by incision 28), and glues sealing panel 6 temporarily (i.e. detachably whenever sealing panel 6 is opened) to walls 19 and 23 of collar 17.

In the alternative embodiment shown in FIGS. 11-14, collar 17 has no top wall 23 or rear wall 25, and reclosable sealing panel 6 is permanently fixed directly to rear wall 26 of inner package 3. The non-dry, re-stick adhesive on inner surface 27 of sealing panel 6 glues sealing panel 6 permanently (i.e. non-detachably) to rear wall 26 of inner package 3 and to detachable portion 29 of collar 17 (which in turn is glued permanently to the part of inner package 3 bounded by incision 28), and glues sealing panel 6 temporarily (i.e. detachably whenever sealing panel 6 is opened) to walls 19 and 23 of collar 17.

In the FIGS. 6-10 embodiment, the detachable portion 29 of collar 17 extends on front wall 19 and top wall 23 of collar 17, whereas, in the alternative embodiment in FIGS. 11-14, detachable portion 29 of collar 17 only extends on front wall 19 of collar 17. In a further embodiment not shown, collar 17 has no detachable portion 29, and inner surface 27 of sealing panel 6 directly contacts the part of inner package 3 bounded by incision 28, without the at least partial interposition of detachable portion 29.

In the FIG. 6-10 embodiment, reclosable sealing panel 6 is made of flexible material (typically plastic), whereas, in the FIG. 11-14 embodiment, reclosable sealing panel 6 is made of rigid material (typically the same material, i.e. cardboard, as collar 17), and has a transverse fold line 36 (FIG. 13) along a transverse edge between front wall 20 and top wall 24 of inner package 3, and a transverse fold line 37 (FIG. 13) along a transverse edge between top wall 24 and rear wall 26 of inner package 3.

Figure 13:
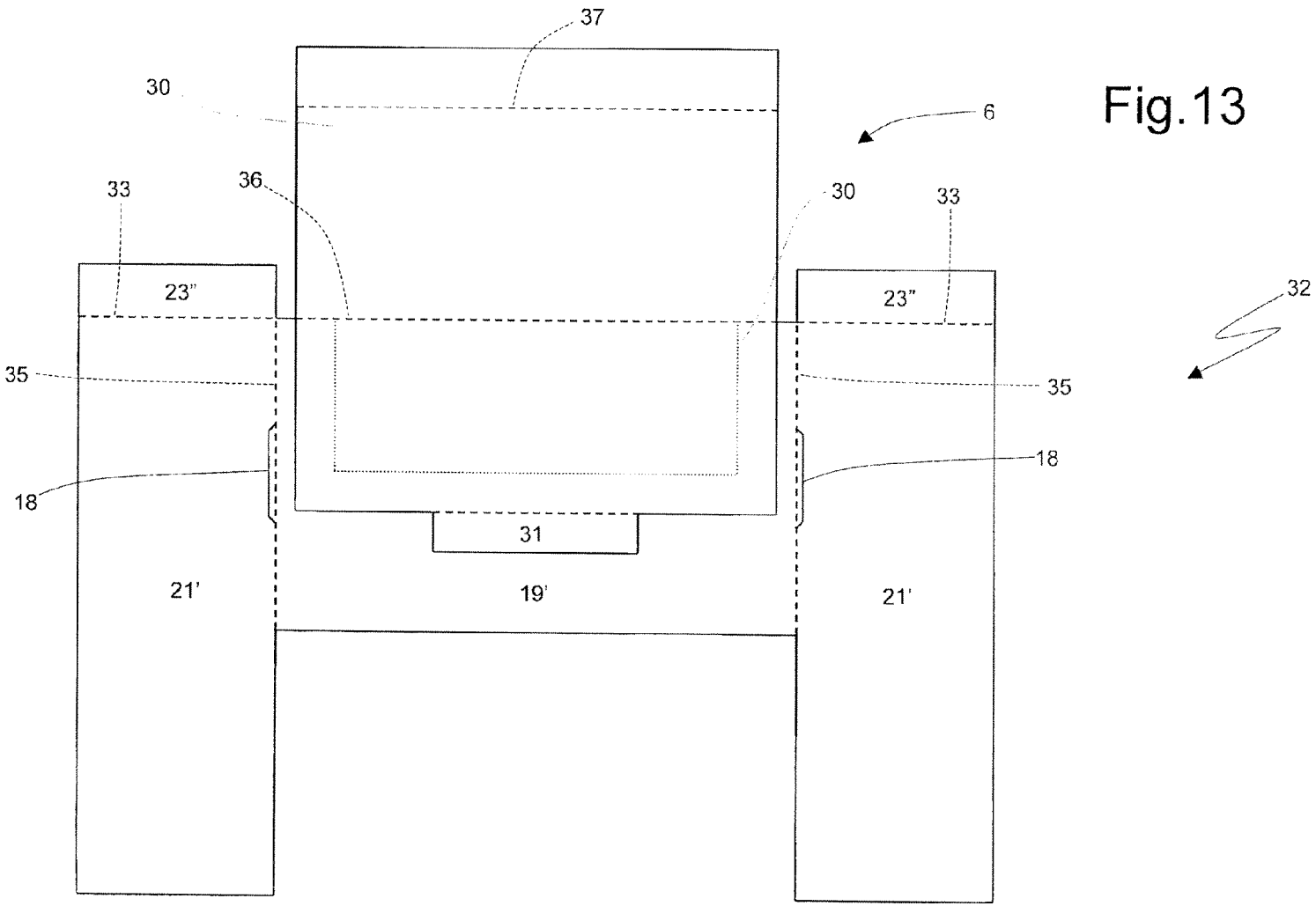
FIG. 13 shows a spread-out plan view of the FIGS. 11 and 12 collar.
Figure 14:
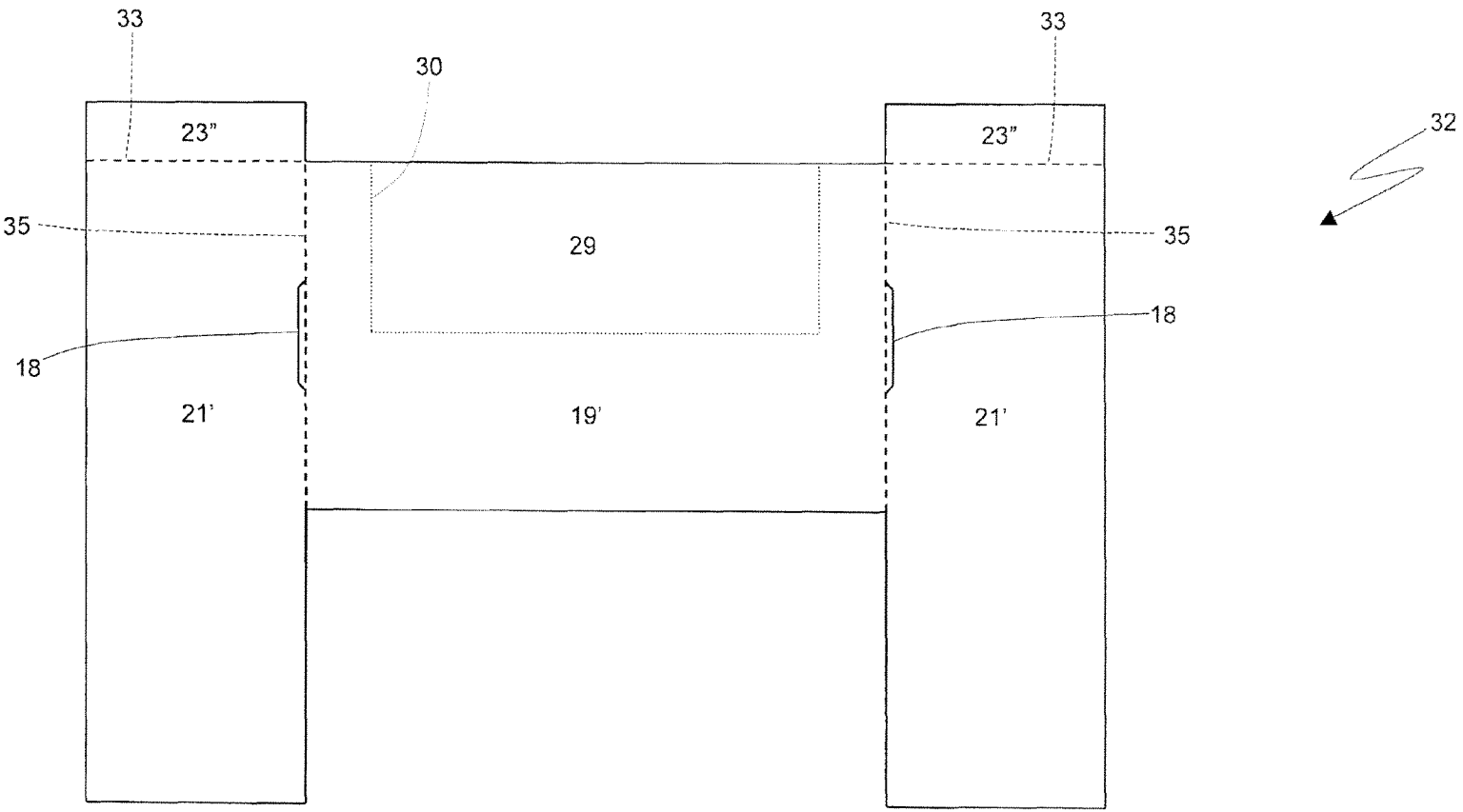
FIG. 14 shows a spread-out plan view of the FIG. 13 collar without a reclosable sealing panel.

As shown in FIGS. 13 and 14, the blank 32 from which the FIG. 11-14 embodiment of collar 17 is formed comprises a panel 19' forming front wall 19 of collar 17; two panels 21', which form lateral walls 21 of collar 17, are located on opposite sides of panel 19', and are separated from panel 19' by the two longitudinal fold lines 35; and two tabs 23", which form top wall 23 of collar 17, are located on opposite sides of panel 23', and are separated from panel 23' by transverse fold line 33. FIG. 14 clearly shows the detachable portion 29 of collar 17, which only extends over panel 19' (i.e. front wall 19).

Figure 15:
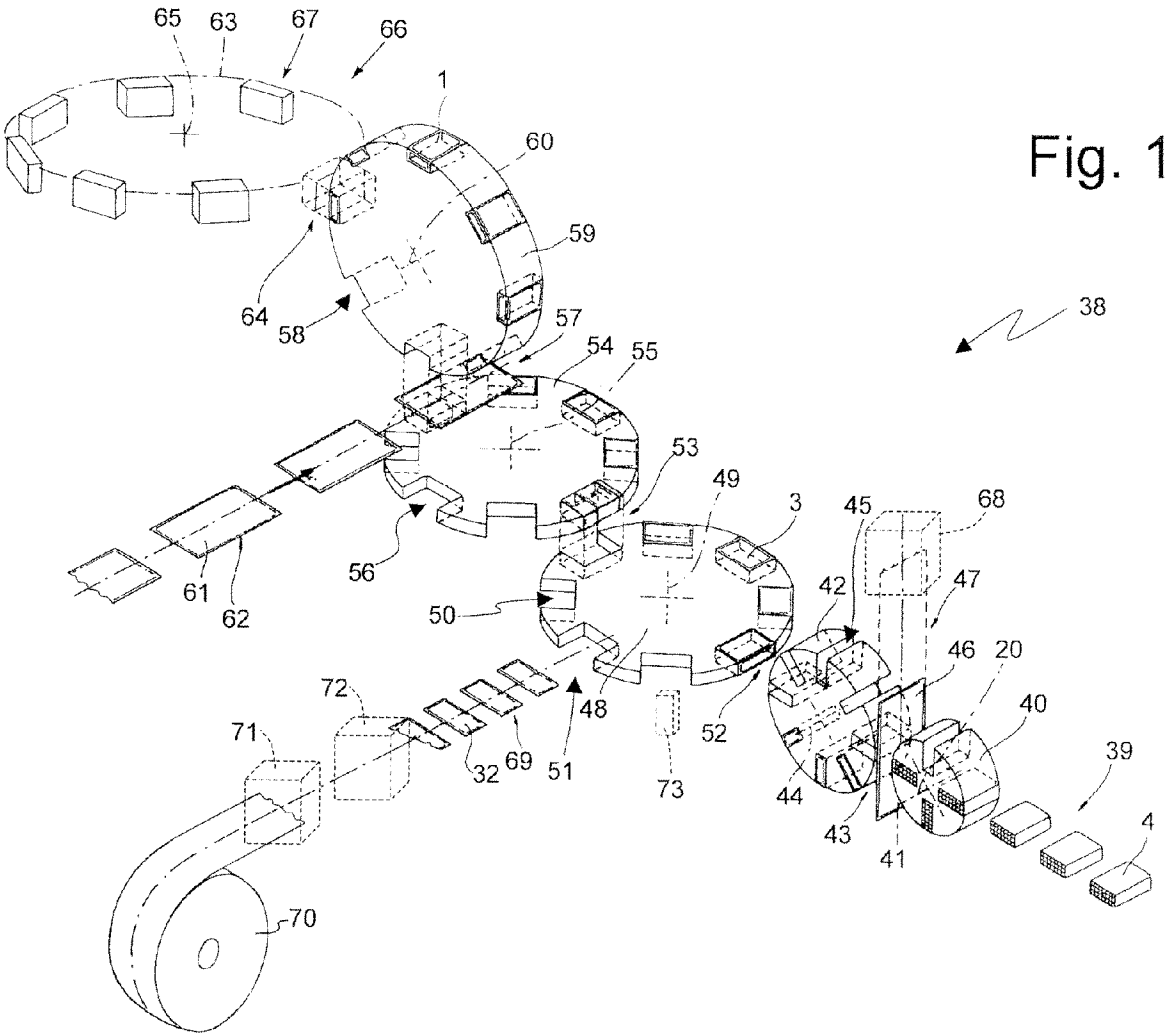
FIG. 15 shows a schematic view in perspective, with parts removed for clarity, of part of a packing machine for producing the FIG. 1 packet of cigarettes.

FIG. 15 shows a schematic overall view of an X2, X3, X3000 or X6 model cigarette packing machine 38 manufactured by G.D. Società per Azioni to produce a packet 1 of cigarettes of the type described above and shown in FIGS. 1-14.

Packing machine 38 comprises a known line 39 (only shown partly) for forming groups 4 of cigarettes; and a first transfer wheel 40, which rotates in steps about a respective horizontal axis of rotation 41 to successively receive groups 4 of cigarettes, and to transfer groups 4 of cigarettes to a second packing wheel 42 at a transfer station 43. Second packing wheel 42 is mounted to rotate in steps about a respective axis of rotation 44 parallel to axis of rotation 41, comprises a number of peripheral pockets 45, each for receiving a group 4 of cigarettes together with a respective flexible sheet 46 of foil packing material fed to transfer station 43 by a feed line 47, and folds each sheet 46 of packing material about respective group 4 of cigarettes to form an inner package 3.

Packing machine 38 also comprises a third packing wheel 48, which rotates in steps about a respective vertical axis of rotation 49 crosswise to axis of rotation 41. Third packing wheel 48 comprises a number of peripheral pockets 50, which are rotated in steps about axis of rotation 49 and fed successively through a feed station 51 for supplying creased cardboard blanks 32 complete with sealing panels 6 and from which to form collars 17. At feed station 51, each pocket 50 receives a blank 32, which is folded into a U inside pocket 50 by folding, panels 23' ninety degrees with respect to panel 19' about the two longitudinal fold lines 35. Third packing wheel 48 also rotates through a transfer station 52 for transferring inner packages 3, and where an inner package 3 is inserted into the U-folded blank 32 inside each pocket 50. Downstream from transfer station 52, folding devices (not shown) finish folding each blank 32 about inner package 3 to form respective collar 17 complete with sealing panel 6. Finally, third packing wheel 48 rotates through a transfer station 53, where each inner package 3, fitted with a collar 17 complete with sealing panel 6, is expelled from pocket 50 and transferred to a fourth packing wheel 54. Fourth packing wheel 54 rotates in steps about a respective axis of rotation 55 parallel to axis of rotation 49, is structurally identical to third packing wheel 48, and comprises a number of peripheral pockets 56. In pockets 50 on third packing wheel 48, and pockets 56 on fourth packing wheel 54, each rectangular-parallelepiped-shaped inner package 3 is positioned flat, i.e. with a minor lateral surface facing outwards, and with its longitudinal axis (the axis parallel to the cigarette axes) crosswise to axes of rotation 49, 55, and tangent to the periphery of packing wheels 48, 54. Fourth packing wheel 54 and third packing wheel 48 overlap at transfer station 53, and inner packages 3 are transferred from third packing wheel 48 to fourth packing wheel 54 in a vertical movement parallel to axes of rotation 49, 55.

At a transfer station 57, each inner package 3, fitted with a collar 17 complete with sealing panel 6, is transferred from a pocket 56 on fourth packing wheel 54 to a pocket 58 on a fifth packing wheel 59. Fifth packing wheel 59 is mounted to rotate in steps about a respective horizontal axis of rotation 60 parallel to axis of rotation 41, receives each inner package 3 and respective collar 17, complete with sealing panel 6, together with a respective rigid blank 61 fed to transfer station 57 by a feed line 62, and folds each blank 61 about relative inner package 3 to form a packet 1 of cigarettes, in which inner package 3 is housed inside an outer container 2 (FIGS. 1-3) formed by folding blank 61.

Packets 1 are transferred successively from fifth packing wheel 59 to a sixth transfer wheel 63 at a transfer station 64. More specifically, each packet 1 arriving at transfer station 64 is positioned on edge on the periphery of fifth packing wheel 59, i.e. with a major lateral surface of packet 1 facing outwards, and with the longitudinal axis (the axis parallel to the cigarettes) of packet 1 parallel to axis of rotation 60 of fifth packing wheel 59.

Sixth transfer wheel 63 rotates in steps about a respective vertical axis of rotation 65 crosswise to axis of rotation 60 of fifth packing wheel 59, receives packets 1 successively from fifth packing wheel 59 at transfer station 64, and transfers packets 1 to a drying area 66 (not shown schematically) at a transfer station 67. Drying area 66 forms the output of packing machine 38, and feeds packets 1 of cigarettes to a follow-up cellophaning machine (not shown) which applies an overwrap of transparent plastic material about each packet 1 of cigarettes.

Feed line 47 supplying flexible sheets 46 of foil packing material has a cutting device 68, which makes U-shaped incision 28, defining cigarette extraction opening 5, in each sheet 46.

Blanks 32 from which collars 17 are made are fed to feed station 51 on a feed line 69, and are obtained in known manner by transversely cutting a continuous strip of cardboard unwound off a reel 70. Feed line 69 comprises a cutting device 71 for forming in each blank 32 U-shaped incision 30 defining detachable portion 29 of collar 17, which adheres to reclosable sealing panel 6; and an application device 72 for applying reclosable sealing panel 6 to each blank 32. Reclosable sealing panel 6 is preferably obtained from a reel, with non-dry, re-stick adhesive already applied to inner surface 27 (i.e. is self-adhesive).

A gumming device 73 applies adhesive (non-dry, re-stick or permanent adhesive) to the side of detachable portion 29 of each collar 17 facing inner package 3, so that detachable portion 29 adheres to the part of inner package 3 bounded by incision 28. In FIG. 15, gumming device 73 is located at packing wheel 48, but may alternatively be located along feed line 69. Gumming device 73 applies adhesive to at least detachable portion 29 of each collar 17, but may also apply adhesive to parts of collar 17 other than detachable portion 29, so as to glue collar 17 to inner package 3. In this way, even when half-empty, inner package 3 is supported by rigid collar 17 and so prevented from collapsing and making it difficult to withdraw the cigarettes through extraction opening 5.

Packet 1 of cigarettes described has numerous advantages.

Firstly, sealed inner package 3 effectively protects the cigarettes inside against external agents, and so preserves the organoleptic characteristics of the tobacco for a long period of time.

Secondly, by virtue of collar 17 supporting sealing panel 6, sealed inner package 3 is extremely rigid about extraction opening 5, and so does not collapse when half-empty, thus making the last cigarettes easy to withdraw, and sealing panel 6 easy to open and close.

Finally, packet 1 of cigarettes described can easily be produced on a standard packing machine (which only requires a few minor alterations), as opposed to a special, high-cost packing machine i.e. specially designed for packets of cigarettes of this type).

In view of its many advantages, the package described may also be used for articles other than cigarettes, e.g. food products (such as sweets, chocolates or other confectionary).

The invention claimed is:

1. A rigid package comprising:

a group (4) of articles;

an inner package (3) enclosing the group (4) of articles, and having an extraction opening (5) defined by a U-shaped first incision (28);

a reclosable sealing panel (6) for closing the extraction opening (5) of the inner package (3);

a rigid outer container (2) housing the inner package (3) and having an open end (7); and a rigid collar (17) which projects partly from the open end (7) of the outer container (2) is folded about the inner package (3) to at least partly cover a top portion of the inner package (3), and is fixed to the inner package (3); and wherein the reclosable sealing panel (6) is positioned over the collar (17), and has an inner surface (27) gummed with non-dry, re-stick adhesive, and which adheres to the collar (17) when the reclosable sealing panel (6) is in a closed position; and wherein the reclosable sealing panel is fixed permanently at a rear wall (26) of the inner package (3).

2. A package as claimed in claim 1, wherein the collar (17) has no rear wall, and the reclosable sealing panel (6) is permanently fixed directly to the rear wall (26) of the inner package (3).

3. A package as claimed in claim 1, wherein the collar (17) comprises a rear wall (25) that partly covers the rear wall (26) of the inner package (3), and the reclosable sealing panel (6) is fixed permanently at the rear wall (26) of the inner package (3) with the interposition of the rear wall (25) of the collar (17).

4. A package as claimed in claim 1, wherein the reclosable sealing panel (6) incorporates a detachable portion (29) of the collar (17), which is separated from the rest of the collar (17) by a U-shaped second incision (30), is glued on one side to the sealing panel (6), and on the opposite side is glued to the part of the inner package (3) enclosed by the first incision (28).

5. A package as claimed in claim 4, wherein the detachable portion (29) of the collar (17) only extends in a front wall (19) of the collar (17).

6. A package as claimed in claim 4, wherein the detachable portion (29) of the collar (17) extends in a front wall (19) and a top wall (23) of the collar (17).

7. A package as claimed in claim 1, wherein the reclosable sealing panel (6) rotates between a closed position and an open position, closing and opening the extraction opening (5) respectively, about a hinge located along a transverse edge between a top wall (24) of the inner package (3) and a rear wall (26) of the inner package (3).

8. A package as claimed in claim 1, wherein the reclosable sealing panel (6) is made of rigid material, and has transverse fold lines (36, 37) located along a transverse edge between a front wall (20) of the inner package (3) and a top wall (24) of the inner package (3), and along a transverse edge between the top wall (24) of the inner package (3) and a rear wall (26) of the inner package (3).

9. A package as claimed in claim 1, wherein the collar (17) is made from a single blank (32) folded about the inner package (3); the blank (32) comprising:

a first panel (19') forming a front wall (19) of the collar (17);

a second panel (23') forming a top wall (23) of the collar (17) and separated from the first panel (19') by a first transverse fold line (33);

a third panel (25') forming a rear wall (25) of the collar (17) and separated from the second panel (23') by a second transverse fold line (34); and two fourth panels (21'), which form the lateral walls (21) of the collar (17), are located on opposite sides of the first panel (19'), and are separated from the first panel (19') by two longitudinal fold lines (35).

10. A package as claimed in claim 9, wherein the blank (32) comprises two tabs (23"), which are glued to the inside of the second panel (23'), are located on opposite sides of the second panel (23'), and are separated from the second panel (23') by the first transverse fold line (33).

11. A package as claimed in claim 9, wherein the collar (17) is made from a single blank (32) folded about the inner package (3); the blank (32) comprising:

a first panel (19') forming a front wall (19) of the collar (17); and two fourth panels (21'), which form the lateral walls (21) of the collar (17), are located on opposite sides of the first panel (19'), and are separated from the first panel (19') by two longitudinal fold lines (35).

12. A package as claimed in claim 11, wherein the blank (32) comprises two tabs (23"), which form a top wall (23) of the collar (17), and are separated from the second panel (23') by the first transverse fold line (33).

13. A package as claimed in claim 1, wherein the reclosable sealing panel (6) has a grip tab (31) with no re-stick adhesive.

14. A package as claimed in claim 1, wherein the rigid outer container (2) is cup-shaped, and has an open top end (7); and a cup-shaped lid (8) hinged to the outer container (2) along a hinge (9) to rotate, with respect to the outer container (2), between an open position and a closed position opening and closing the open top end (7) respectively.

* * * * *